US005900574A

United States Patent [19]

Hart

[11] Patent Number: 5,900,574

[45] Date of Patent: May 4, 1999

[54] RELOADING APPARATUS WHICH AUTOMATICALLY SETS A BULLET INTO THE MOUTH OF A CASING

[76] Inventor: Larry L. Hart, 3201 Donna Dr., Lafayette, Ind. 47905

[21] Appl. No.: 08/933,570

[22] Filed: Sep. 19, 1997

[51] Int. Cl.[6] ..... F42B 10/00; F42B 33/00

[52] U.S. Cl. ..... 86/43; 86/23; 86/25; 86/29; 86/31; 86/39

[58] Field of Search ..... 86/43, 44, 23, 86/24, 25, 26, 27, 29, 31, 32, 36, 39, 42

[56] References Cited

U.S. PATENT DOCUMENTS

| | | | |
|---|---|---|---|
| Re. 34,612 | 5/1994 | Bender et al. . | |
| 2,600,488 | 6/1952 | Crump | 86/43 |
| 2,719,453 | 10/1955 | Bahler | 86/43 |
| 3,204,518 | 9/1965 | Jackson | 86/43 |
| 3,440,923 | 4/1969 | Purdie | 86/43 |
| 4,031,804 | 6/1977 | Boschi | 86/23 |
| 4,228,724 | 10/1980 | Leich . | |
| 4,331,063 | 5/1982 | Schaenzer | 86/43 |
| 4,343,222 | 8/1982 | Dillon . | |
| 4,522,102 | 6/1985 | Pickens . | |
| 4,615,255 | 10/1986 | Carter . | |
| 4,637,291 | 1/1987 | Alexander | 86/43 |
| 4,766,798 | 8/1988 | David et al. . | |

*Primary Examiner*—Charles T. Jordan
*Assistant Examiner*—Theresa M. Wesson
*Attorney, Agent, or Firm*—Maginot, Addison & Moore

[57] ABSTRACT

A reloading apparatus is disclosed. The apparatus includes a support for supporting a casing and a casing feed station for placing the casing on the support. The apparatus also includes a primer removal station for resizing the casing and removing a spent primer from the casing. The apparatus further includes an expanding station for enlarging a diameter of a mouth of the casing. The apparatus still further includes a primer insertion station for inserting a charged primer into the casing. The apparatus also includes a gunpowder dispensing station for dispensing a quantity of gunpowder into the casing. The apparatus further includes a bullet setting station for setting a bullet into the casing so as to form a cartridge. The bullet setting station includes a bullet aligner for positioning a bullet adjacent the mouth of the casing, and a plunger. The plunger is movable between a first plunger position and a second plunger position. The plunger contacts the bullet so as to advance the bullet into the mouth of the casing when the plunger is moved from the first plunger position to the second plunger position. The apparatus further includes a crimping station for advancing the bullet a distance into the casing and reducing the diameter of the mouth of the casing. The apparatus yet further includes an ejection station for ejecting the cartridge from the support. A method of reloading a casing is also disclosed.

19 Claims, 10 Drawing Sheets

RELOADING APPARATUS WHICH AUTOMATICALLY SETS A BULLET INTO THE MOUTH OF A CASING

TECHNICAL FIELD OF THE INVENTION

The present invention relates generally to a reloading apparatus, and more specifically to a reloading apparatus which automatically sets a bullet into the mouth of a casing.

BACKGROUND OF THE INVENTION

Many gun enthusiasts involved in hunting or target shooting reload their own cartridges. There are several reasons to reload a cartridge rather than buying a new cartridge. Primarily, the gun enthusiast will reload a cartridge to save money. In particular, a cartridge includes a casing, a bullet, gunpowder, and a charged primer. After a cartridge has been fired, the casing and a spent primer remain. The cost of a bullet, gunpowder, and a charged primer is significantly less than the price of a new cartridge. In addition, the gun enthusiast is able to experiment with a variety of different bullet and gunpowder combinations, which enables the gun enthusiast to make customized cartridges for a specific purpose.

A typical reloading apparatus will consist of a rotable turntable with a plurality of stations. As the turntable is raised and lowered, the turntable is indexed to advance a casing to the next station. At each station one of the following reloading operations is performed: (1) placing a casing on the turntable, (2) removing the spent primer from the casing, (3) resizing the casing to eliminate any expansion caused by firing the cartridge, (4) opening the mouth of the casing to facilitate insertion of a bullet at a subsequent station, (5) inserting a charged primer into the casing, (6) dispensing a predetermined amount of gunpowder into the casing, (7) placing a bullet into the mouth of the casing, (8) advancing the bullet a distance into the casing, (9) crimping the mouth of the casing that was widened at a previous station which allows the bullet to be fed into the gun, and (10) ejecting the reloaded cartridge from the reloader.

The manner in which the casing is positioned and retained on the turntable is of paramount importance. Misalignment of the casing at one of the reloading stations has several disadvantages associated therewith. For example, small misalignments may adversely affect the accuracy of the reloaded cartridge. Larger misalignments many cause the reloading apparatus to become jammed, possibly damaging the cartridge and thereby making the cartridge unusable.

It is also important not to retain a casing on the turntable in too tight a manner. In particular, when a casing is retained on the turntable in an extremely tight manner, it is difficult to eject the cartridge at the final station. Therefore, a mechanism to eject the cartridge from the turntable must be found that is compatible with the mechanism used to retain the casing on the turntable.

Another critical station is the station that positions the bullet in the casing. The bullet must be properly aligned with the casing in a consistent manner. Highly accurate shooting requires that there be little variation from one cartridge to the next. A disadvantage associated with reloaders that have heretofore been designed is that bullets are not properly aligned in the mouth of cartridges in a consistent manner.

The present invention is directed to overcoming one or more of the disadvantages set forth above.

SUMMARY OF THE INVENTION

In accordance with a first embodiment of the present invention, there is provided an apparatus for setting a bullet into a casing. The apparatus includes a support for supporting the casing, a bullet aligner for positioning the bullet adjacent a mouth of the casing, and a plunger. The plunger is movable between a first plunger position and a second plunger position. The plunger contacts the bullet to advance the bullet into the mouth of the casing when the plunger moves from the first plunger position to the second plunger position.

In accordance with a second embodiment of the present invention, there is provided reloading apparatus. The reloading apparatus includes a support for supporting a casing. The apparatus further includes a casing feed station for placing the casing on the support. The apparatus still further includes a primer removal station for removing a spent primer from the casing and resizing the casing. The apparatus further includes an expanding station for enlarging a diameter of a mouth of the casing. The apparatus still further includes a primer insertion station for inserting a charged primer into the casing. The apparatus yet further includes a gunpowder dispensing station for dispensing a quantity of gunpowder into the casing. The apparatus further includes a bullet setting station for setting a bullet into the casing so as to form a cartridge. The bullet setting station includes a bullet aligner for positioning a bullet adjacent the mouth of the casing, and a plunger. The plunger is movable between a first plunger position and a second plunger position. The plunger contacts the bullet so as to advance the bullet into the mouth of the casing when the plunger is moved from the first plunger position to the second plunger position. The apparatus further includes a crimping station for advancing the bullet a distance into the casing and reducing the diameter of the mouth of the casing. The apparatus yet further includes an ejection station for ejecting the cartridge from the support.

In accordance with a third embodiment of the present invention, there is provided a method of reloading a casing. The method includes the step of placing a casing on a support. The method further includes the step of removing a spent primer from the casing and resizing the casing. The method still further includes the step of enlarging a diameter of a mouth of the casing. The method further includes the step of inserting a charged primer into the casing. The method still further includes the step of dispensing a quantity of gunpowder into the casing. The method further includes the step of setting a bullet into the casing so as to form a cartridge. The setting step includes the steps of aligning the bullet adjacent the mouth of the casing, and contacting the bullet with a plunger so as to advance the bullet into the mouth of the casing. The method still further includes the step of advancing the bullet a distance into the casing and reducing the diameter of the mouth of the casing. The method yet further includes the step of ejecting the cartridge from the support.

BEST MODE FOR CARRYING OUT THE INVENTION

Figure 1:
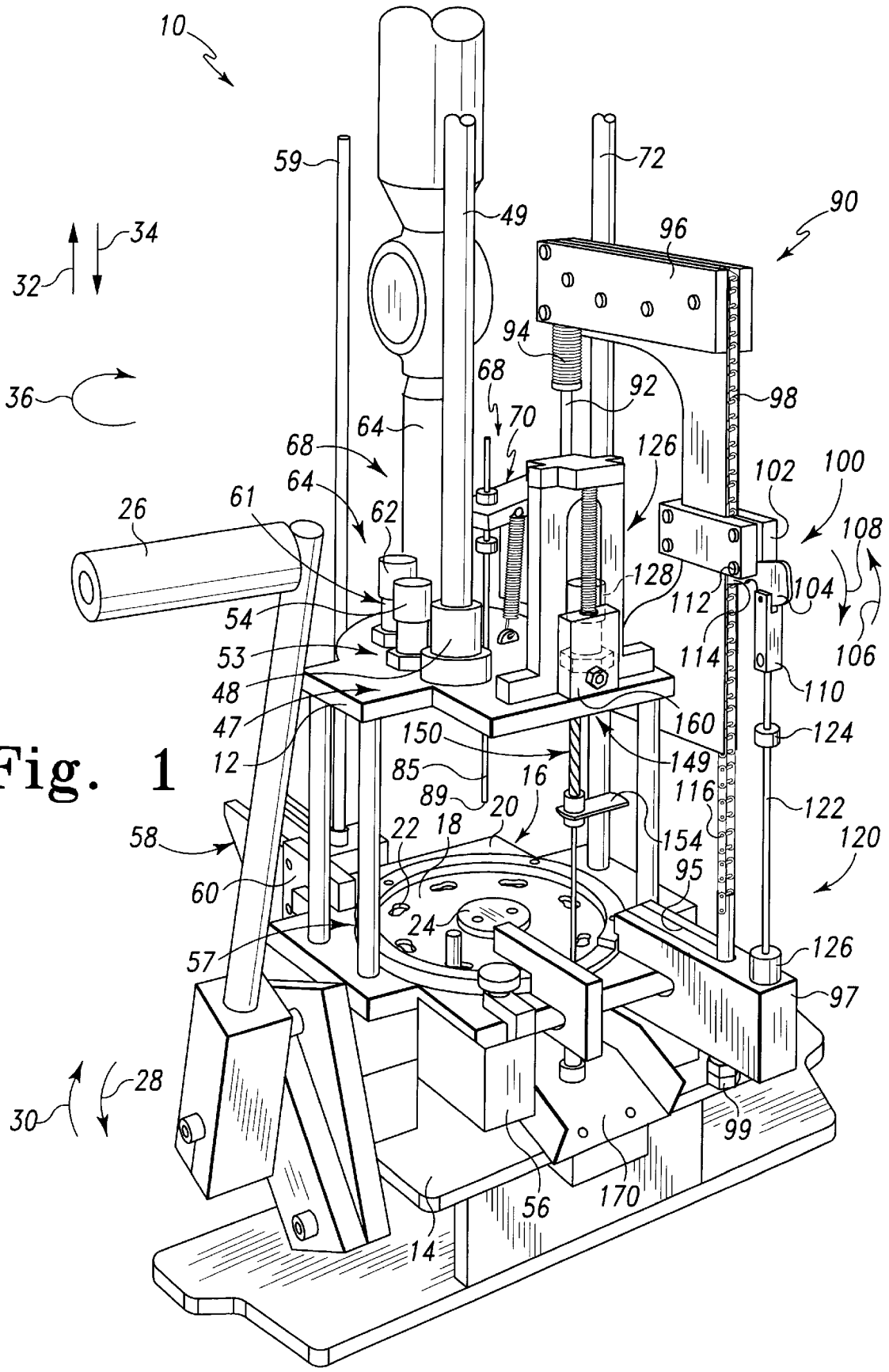
FIG. 1 is a perspective view of a reloader which incorporates the features of the present invention therein, with the reloader shown at the start of a downward stroke of the handle 26.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
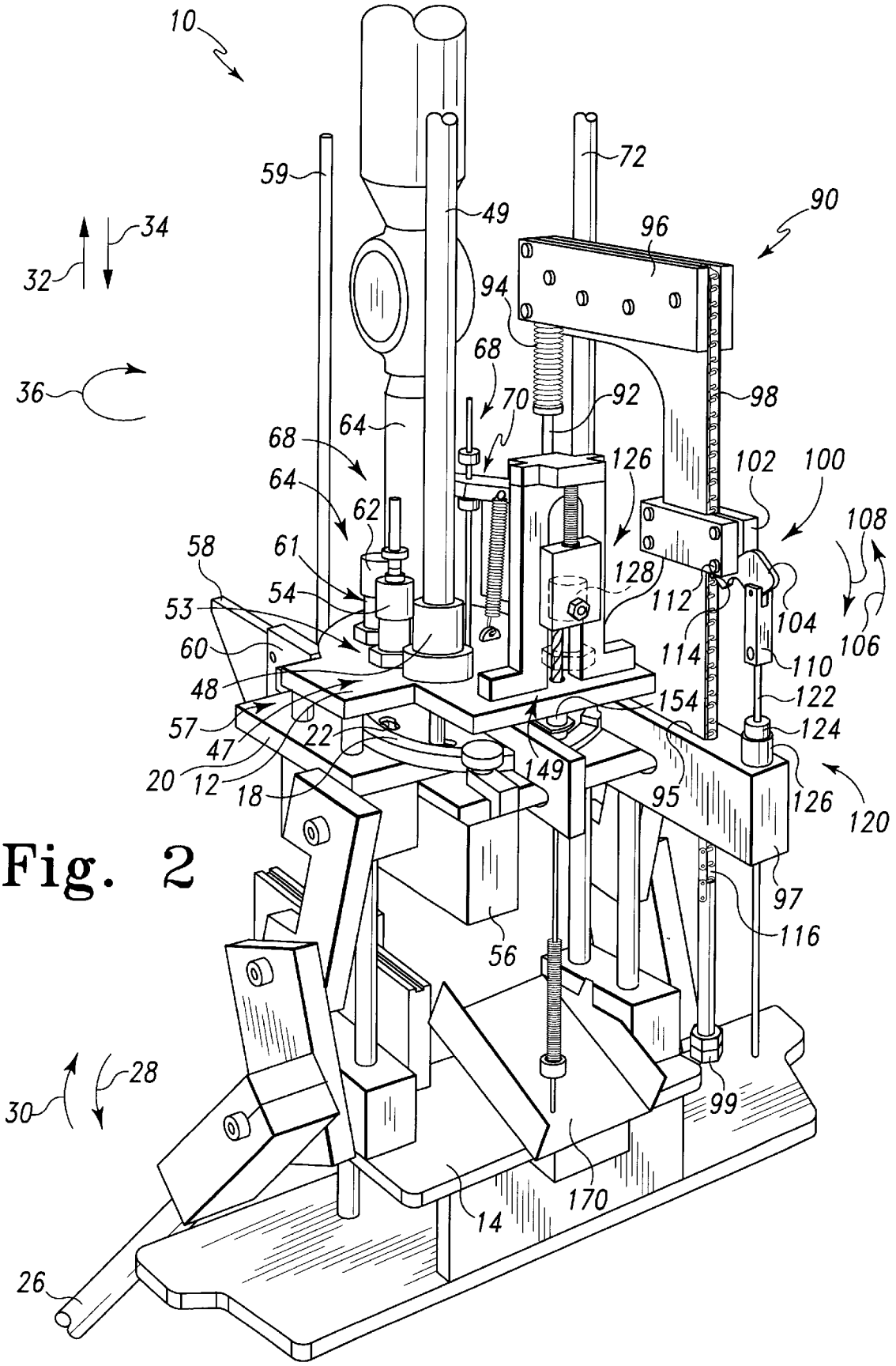
FIG. 2 is view similar to FIG. 2, but showing the reloader at the end of a downward stroke of the handle 26.

Referring now to FIGS. 1–2, there is shown a reloader 10. The reloader 10 includes an upper platform 12 and a lower platform 14. The reloader 10 further includes a support assembly 16. The support assembly 16 includes an upper support 18 and a lower support 20. The upper support 18 has eight casing apertures 22 defined therein. The upper support 18 is movable relative to the lower support 20. In particular, the upper support 18 rotates about a hub 24 while the lower support 20 remains stationary relative to the hub 24.

The reloader 10 further includes a handle 26 coupled the support assembly 16 via a mechanical linkage (not shown). A cycle of the handle 26 includes a downward stroke followed by an upward stroke. On the downward stroke, the handle 26 is moved from an upper handle position (see FIG. 1) to a lower handle position (see FIG. 2) in the general direction of arrow 28 thereby causing the mechanical linkage to move the support assembly 16 from a lower support position (see FIG. 1) to an upper support position (see FIG. 2). On the upward stroke, the handle 26 is moved from a lower handle position (see FIG. 2) to an upper handle position (see FIG. 1) in the general direction of arrow 30 thereby causing the mechanical linkage to move the support assembly 16 from an upper support position (see FIG. 2) to a lower support position (see FIG. 1).

Furthermore, as the handle 26 is moved at the end of its upward stroke, the upper support 18 is advanced approximately forty five degrees in the general direction of arrow 36 (see FIG. 3) relative to the lower support 20. This also advances each of the casing apertures 22 one eighth of the distance around the hub 24 in the general direction of arrow 36. Thus, eight cycles of the handle 26 return each of the casing apertures 22 to its original position.

Each of the eight positions of the casing aperture 22 corresponds with one of a plurality of workstations on the reloader 10. In particular, the plurality of workstations includes a casing feed station 47, a primer removal station 53, a primer insertion station 57, an expanding station 61, a gunpowder dispensing station 64, a bullet setting station 68, a crimping station 126, and an ejection station 149. Each of these workstations is positioned directly above or below a corresponding casing aperture 22 position. During each cycle of the handle 26, a number of reloading operations is performed to form a new cartridge 38. The cartridge 38, shown in FIGS. 8–10 includes a casing 40, a bullet 42, a primer (not shown) and a quantity of gunpowder (not shown). The primer is inserted into the base of the casing 38, and the gunpowder and bullet 42 are inserted into a mouth 43 of the casing 40 (see FIG. 3A).

When a gun enthusiast loads a cartridge 38 into his gun and discharges it, only the casing 38 and a spent primer remain. In order to make a new cartridge 38, it is necessary to perform the following steps: (1) the casing 40 must be placed on the support assembly 16, (2) the spent primer must be removed from the casing 40 and the casing must be resized to remove any expansion caused by discharging the cartridge, (3) a charged primer must be inserted into the casing 40, (4) the mouth 43 of the casing 40 must be enlarged so that a bullet 42 can be inserted into the casing 40 at a later step, (5) a quantity of gunpowder is placed in the casing 40, (6) a bullet 42 is set in the mouth 43 of the casing 40, (7) the bullet 42 is advanced to the proper depth into the casing 40 and the mouth 43 of the casing 40 is crimped to its original shape, and (8) the completed cartridge 38 is ejected from the support assembly 16. Each reloading step is performed at a reloading station as the handle 26 is advanced through its downward and upward stroke.

As shown in FIGS. 1, 2, 3A, and 3B, the first reloading station is a casing feed station 47 having a casing feed assembly 48. The casing aperture 22 defined in the upper support 20 includes a feed section 44 and a holding section 46 (see FIG. 3A and 3B). As the handle 26 completes a downward stroke, the feed section 46 is positioned below the casing feed assembly 48. The casing feed assembly 48 includes a casing feed tube 49. At the end of the downward stroke of the handle 26, the casing feed assembly 48 advances a casing 40 from the casing feed tube 49 into the feed section 44 of the casing aperture 22 (see left casing 40 shown in FIG. 3A).

The casing 40 includes a body 41 and a rim 50 extending radially outward from the body 41. The holding section 46 includes a rim recess 52. The feed section 44 has a first width W1 which is greater than the diameter of the rim 50 thereby allowing the casing 40 to rest on the lower support 20. The holding section 46 has a second width W2 sized to receive the body 41 of the casing 40. The first width W1 is greater than the second width W2. The recess 52 has a third width W3 which is sized to receive the rim 50 of the casing 40 therein. The third width W3 is less than the first width W1 and greater than the second width W2.

Figure 3A:
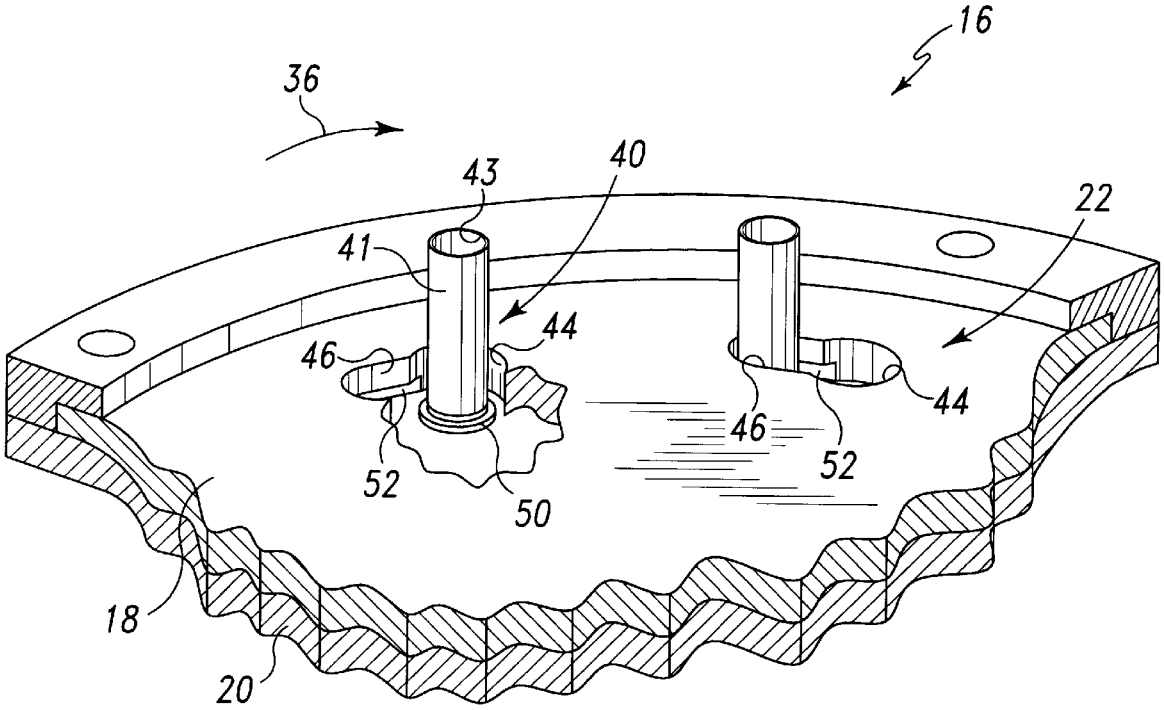
FIG. 3A is a fragmentary cross sectional view of the support assembly of the reloader of FIG. 1.
Figure 3B:
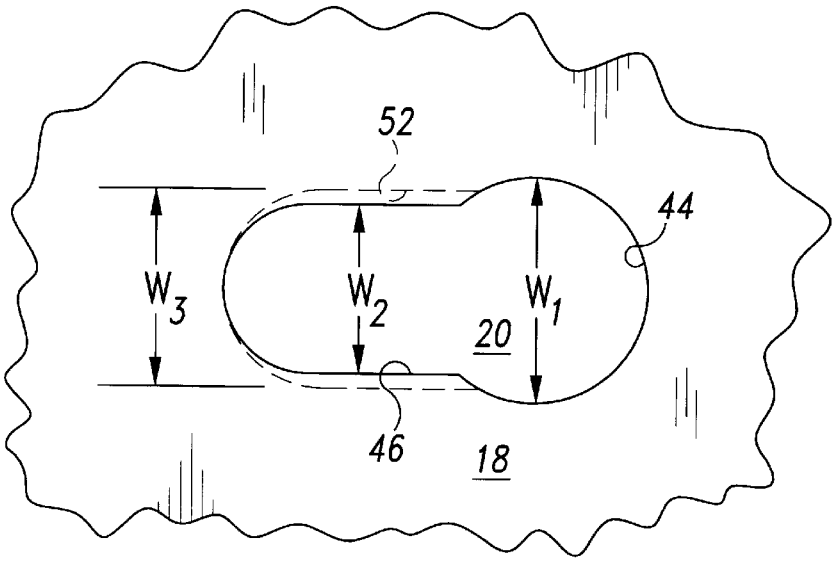
FIG. 3B is a top elevational view of one casing aperture which is defined in the support assembly shown in FIG. 3A.

As described above, at the end of the upward stroke, the lower support is advanced forty five degrees in the general direction of arrow 36 as shown in FIG. 3A. As the lower support advances, the rim 50 is received in the rim recess 52 and the body 41 is received in the holding section 46. Thus, the casing 40 is now securely held in the holding section 46 and supported by the lower support 20 as shown in FIG. 3A.

During the subsequent downward stroke of handle 26, the casing enters the primer removal station 53 which includes a deprimer 54. One example of a deprimer which is suitable for the use in the present invention is included in the .38/.357/.357 Max 3 die set commercially available from Hornady Manufacturing Company of Grand Island, Nebr. The deprimer 54 performs the following operations: (1) the deprimer 54 resizes the casing to remove any expansion caused by firing the cartridge 38, and (2) near the end of the downward stroke, as the casing 40 advances toward the deprimer 54 in the general direction of arrow 32 (see FIG. 1), the deprimer 54 forces the spent primer out of the bottom of the casing 40. The spent primer is then advanced to a primer container 56 positioned under the support assembly 16.

During the subsequent upward stroke of handle 26, the casing is positioned above a primer insertion station 57, which includes a primer insertion assembly 58. The primer insertion assembly 58 includes a primer feed tube 59 and an insertion mechanism 60. As the upward stroke of the handle 26 is completed, a charged primer is fed from the primer feed tube 59 to the insertion mechanism 60. As the support assembly 16 is moved toward the primer insertion mechanism 60 in the general direction of arrow 34 (see FIG. 1) a charged primer is pressed into the base of the casing 40. It should be noted that the primer insertion assembly 58 is similar to the primer insertion assembly of the shotgun shell reloader available from Ponsness-Warren of Rathdrum, Id. as the model Sizamatic 800 B.

The subsequent downward stroke advances the casing 40 to an expanding station 61, where a set of expanding dies 62 enlarges the diameter of the mouth 43 of the casing 40 thereby facilitating the insertion of bullet 42 at a subsequent station. One example of an expanding station which is suitable for use with the present invention is available from Hornady Manufacturing Company of Grand Island, Nebr. and is included in the .38/.357/.357 Max 3 die set.

A subsequent cycle of the handle 26 advances the casing 40 to a gunpowder dispensing station 64, where a gunpowder dispenser 64 dispenses a predetermined quantity of gunpowder into the mouth 43 of the casing 40. One example of a gunpowder dispensing station which is suitable for use with the present invention is available from Hornady Manufacturing Company of Grand Island, Nebr. as model Pistol Powder Measure.

A subsequent cycle of the handle 26 advances the casing 40 to a nonfunctional station. No reloading operation is performed at this station. However, this station is suitably used for removing the casing 40 from the support assembly 16 in order to examine the casing or to analyze the quantity of gunpowder that was deposited in the casing 40 by the gunpowder dispenser 64.

A subsequent upward stroke advances the casing under a bullet setting station 68. The bullet setting station 68 is shown in FIGS. 1–2 and 4–7 and includes a bullet aligner assembly 70 and a plunger assembly 90. The plunger assembly 90 includes a plunger 92, a spring 94, a plunger support 96, a block 97, a chain 98, a locking assembly 100, and a release assembly 120. A first end of the chain 98 is attached to the plunger 92. The chain 98 is received through a central passage defined in the spring 94. The spring 94 is interposed between the plunger 92 and the plunger support 96. The support 96 is securely attached to the upper platform 12. The block 97 is secured to the lower support 20 of the support assembly 16 and has a passage 95 cut vertically therethrough. The chain 98 is routed around the periphery of the support 96 and through the passage 95 of the block 97. A second end of the chain 98 is attached to a tension block 99. Thus, as handle 26 is moved in an upward stroke, the support assembly 16 moves down in the general direction of arrow 34 (see FIG. 1). In turn, the lower surface of the block 97 is moved into contact with the tension block 99 thereby placing a tension in the chain 98. This tension pulls the plunger 92 toward the support 96, thereby compressing the spring 94.

The locking assembly 100 maintains the tension in the chain 98. In particular, the locking assembly 100 includes a mounting bracket 102, a locking member 104, and a counterweight 110. The mounting bracket 102 is securely mounted to the support 96. The locking member 104 is attached to the mounting bracket 102 by a pin 112, such that the locking member 104 is free to pivot about the pin 112 in the direction of arrows 106 and 108. The counterweight 110 is attached to the locking member such that the weight of the counterweight biases the locking member 104 in the general direction of arrow 108. The locking member 104 has a tip 114 advantageously configured to engage the chain 98. In particular, the chain 98 is composed of a series of links having locking notches 116 defined therein. The bias of the counterweight 110 urges the tip 114 into contact with one of the locking notches 116 thereby preventing the chain from moving in the general direction of arrow 32 and maintaining the tension in the chain 98. It should be appreciated that as the chain 98 is maintained in tension, the spring 94 is held in the compressed state between the plunger 92 and the plunger support 96.

During the subsequent downward stroke of the handle 26, the release mechanism 120 disengages the locking member 104 from the respective locking notch 116. In particular, the release mechanism consists of a release rod 122, a timing block 124, and a trigger block 126. One end of the release rod 122 is attached to the counterweight 110 whereas the other end of passes through an aperture (not shown) in the block 97. The timing block 124 is secured to the release rod 122. The trigger block 126 is positioned on the upper surface of the block 97 and about the release rod 122. As the handle 26 is moved in a downward stroke, the support assembly 16, and thus the trigger block 126, move upwardly in the general direction of arrow 32. When the trigger block 126 contacts the timing block 124, the release rod 122 is urged in the general direction of arrow 32. The release rod 122 then urges the counterweight 110 in the general direction of arrow 32, which causes the locking member 104 to pivot about the pin 112 in the direction of arrow 106 thereby disengaging the tip 114 of the locking member 104 from the respective locking notch 116 of the chain 98 (see FIG. 2). It should be appreciated that as the locking member 104 is disengaged from the chain 98, the compressed spring 94 drives the plunger 92 downwardly in the general direction of arrow 34. It should further be appreciated that the timing of the actuation of the plunger 92 can be adjusted. In particular, as the timing block 124 is adjusted upwardly in the general direction of arrow 32, the locking member 104 will be disengaged from the chain 98 at a later point in the downward stroke of handle 26. Whereas, when the timing block 124 is adjusted downwardly in the general direction of arrow 34, the locking member 104 will be disengaged from the chain at an earlier point in the downward stroke of handle 26.

Referring now to FIGS. 4–7, the bullet aligner assembly 70 includes a bullet feed tube 72, an advancement assembly 80, and a bullet support 73. The bullet support 73 is secured to the upper platform 12, and has a bullet opening 74 defined therein. The plunger 92 is aligned in the vertical direction with the bullet opening 74.

Figure 4:
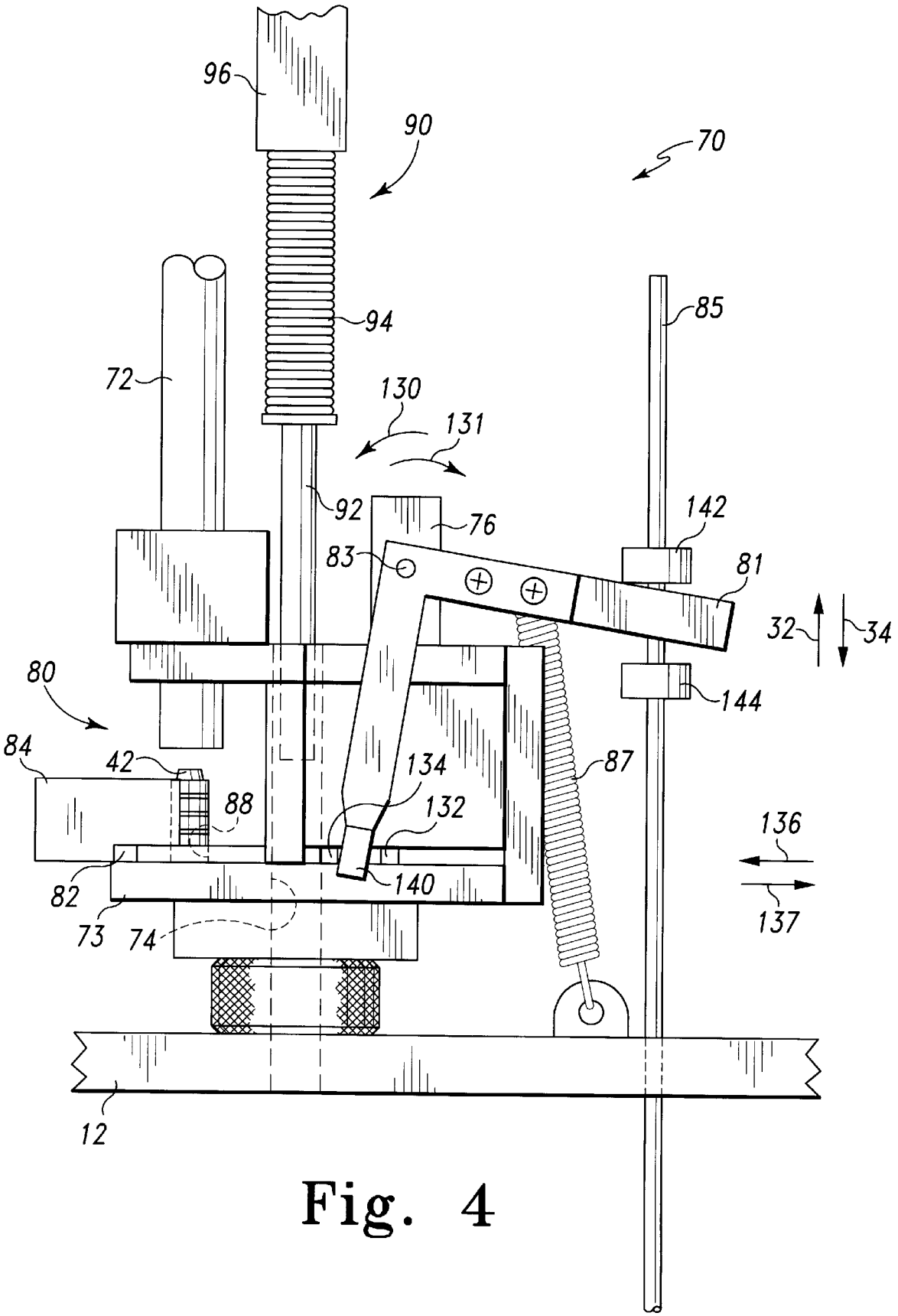
FIG. 4 is an enlarged view of the bullet aligner assembly of the reloader of FIG. 1, with the advancement plate of the bullet aligner assembly shown positioned in a first plate position.
Figure 6:
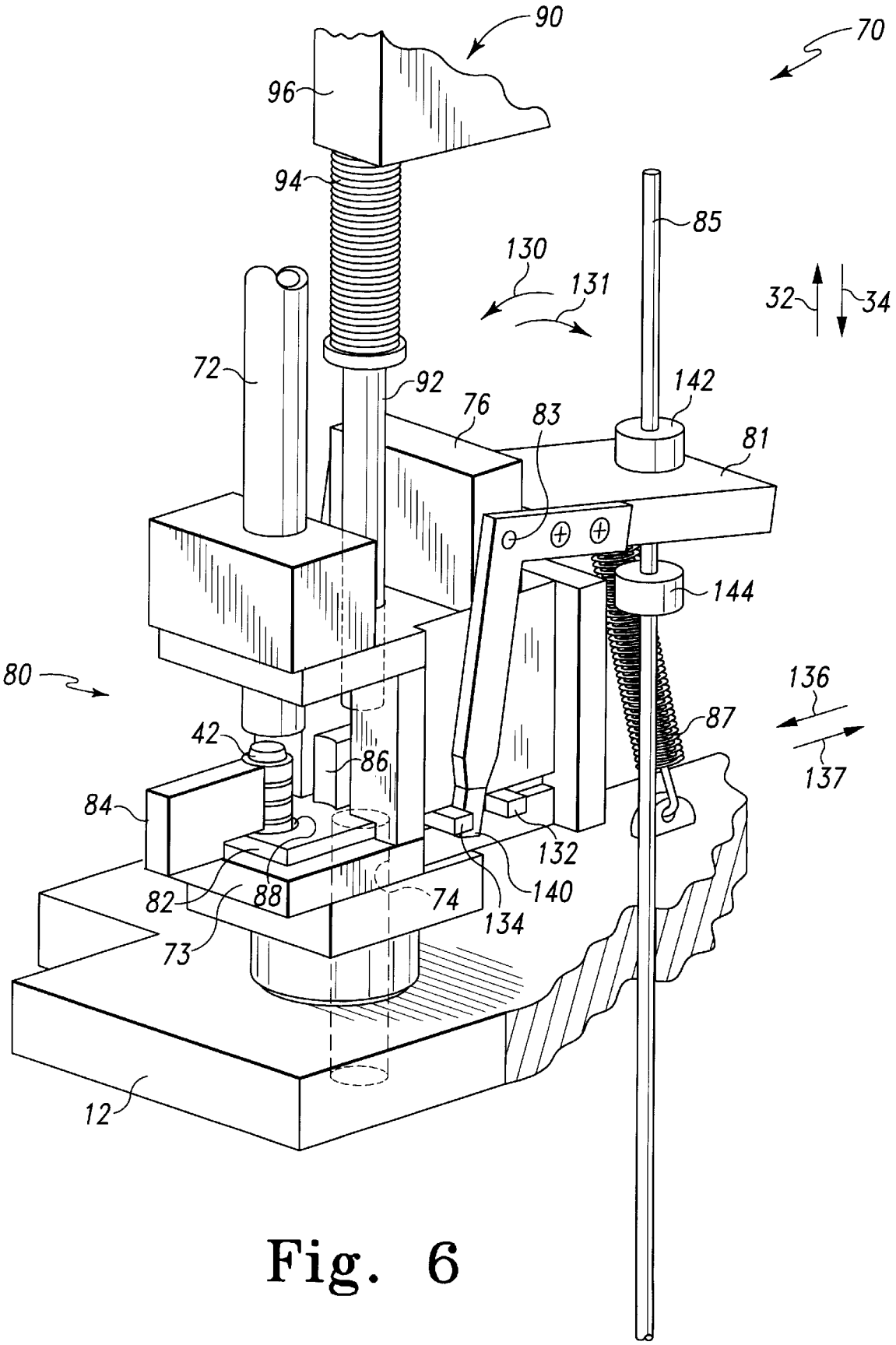
FIG. 6 is a perspective view of the bullet aligner assembly of FIG. 4.

The advancement assembly 80 includes an advancement plate 82, a first finger 84, and a second finger 86. The advancement plate 82 has a bullet opening 88 defined therein. The advancement assembly 80 further includes a pivot arm 81, a pin 83, a rod 85, and a spring 87. The advancement plate 82 further has two shoulders 132 and 134 extending therefrom. A tip 140 of the pivot arm 81 is positioned between the shoulder 132 and the shoulder 134. The pivot arm 81 is movably attached to a frame member 76 by the pin 83, such the pivot arm 81 is free to pivot about the pin 83 in the direction of the arrows 130 and 131. One end of the spring 87 is secured to the upper platform 12, whereas the other end is secured to the pivot arm 81, such that the force of the spring bias of spring 87 urges the pivot arm 81 in the general direction of arrow 131 thereby urging the tip 140 into contact with the shoulder 134. The tip 140 urges the shoulder 134, and the advancement plate 82, in the general direction of arrow 136 into a first plate position as shown in FIGS. 4 and 6. As the advancement plate 82 is positioned in the first plate position, gravity advances the bullet 42 from the feed tube 72 and onto the bullet support 73. In particular, the bullet 42 is received through the bullet opening 88, prior to contacting the bullet support 73. When the bullet 42 is positioned on the bullet support 73, the bullet 42 is positioned in the bullet opening 88. FIGS. 4 and 6 show the bullet positioned in a first bullet position.

As shown in FIG. 6, the second finger 86 is spaced apart from the first finger 84 a distance sufficient to allow the bullet 42 to be advanced into the bullet opening 88. It should be noted that the distance which the second finger 86 is spaced apart from the first finger 84 may be reduced relative to the distance shown in FIG. 6. In particular, the distance which the second finger 86 is spaced apart from the first finger 84 may be a distance slightly larger than the diameter of the bullet 42. Having only a very small distance between the bullet 42 and the second finger 86 eliminates the possibility that the bullet 42 would topple over when the advancement plate 82 is moved in the general direction of arrow 137.

The rod 85 extends through the pivot arm 81 and the upper platform 12. The rod 85 has a lower end 89 protruding downward beneath the upper platform 12 (see FIG. 1). A first disk 142 is secured to the rod 85 above the pivot arm 81, whereas a second disk 144 is secured to the rod 85 beneath the pivot arm 81.

On a downward stroke of the handle 26, as the support assembly 16 moves in the general direction of arrow 32 (see FIG. 1), the upper support 18 contacts the lower end 89 of the rod 85 thereby urging the rod in the general direction of arrow 32. Thus, the second disk 144 is urged into contact with the pivot arm 81, applying a force to the pivot arm in the general direction of arrow 32. When this force overcomes the spring bias of the spring 87, the pivot arm 81 pivots in the general direction of arrow 130 thereby urging the tip 140 of the pivot arm 81 into contact with the shoulder 132 of the advancement plate 82. The tip 140 then urges the advancement plate 82 in the general direction of arrow 137 (see FIGS. 5 and 7).

Figure 5:
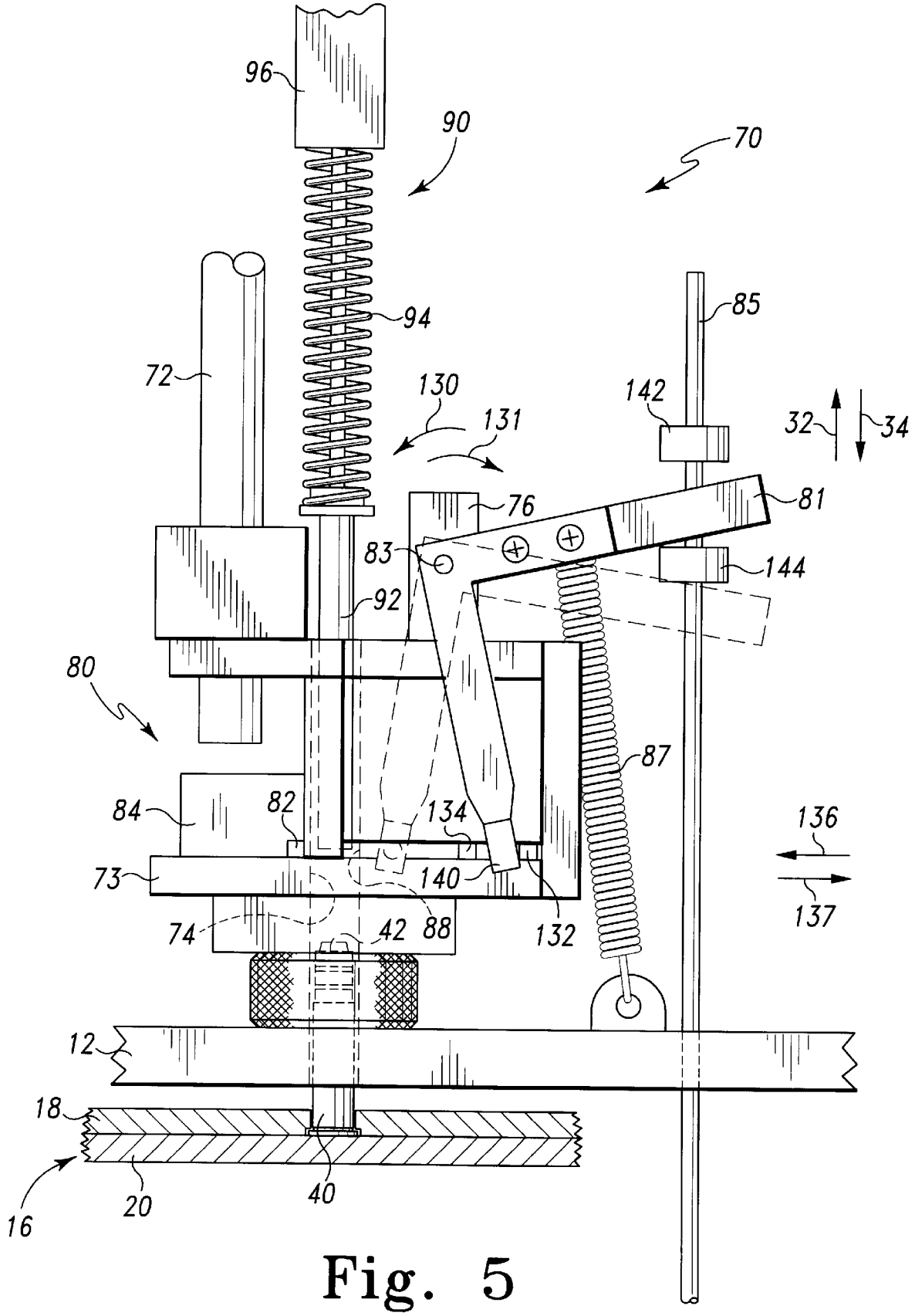
FIG. 5 is view similar to FIG. 4, but showing the advancement plate of the bullet aligner assembly positioned in a second plate position(note that only a portion of the support assembly is shown for clarity of description)
Figure 7:
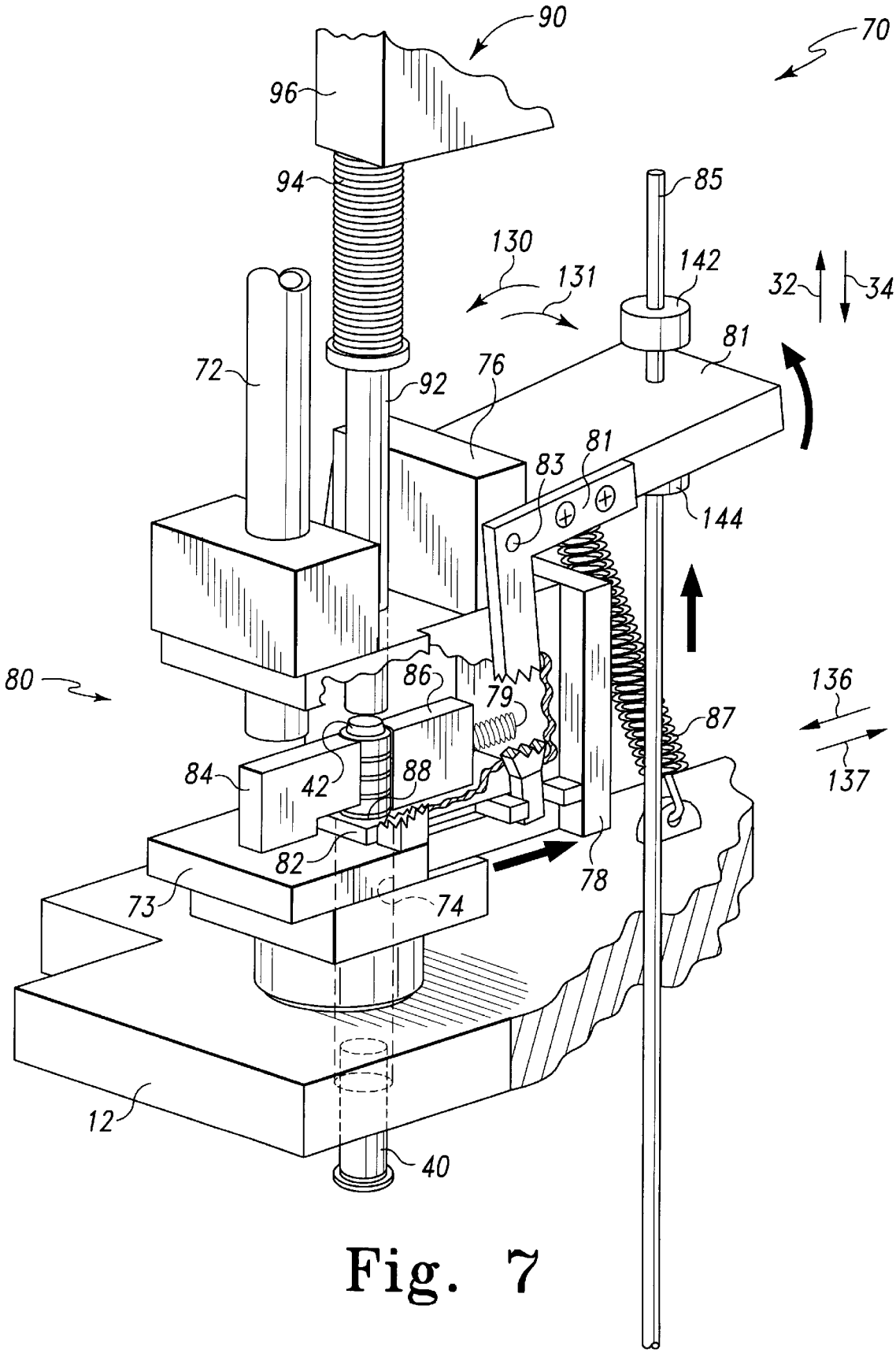
FIG. 7 is view similar to FIG. 6, but showing a portion of the bullet aligner assembly cut away for clarity of description.

As the advancement plate 82 moves in the general direction of arrow 137, the first finger 84 and the advancement plate 82 urge the bullet 42 into contact with the second finger 86. A finger spring 79 is interposed between the second finger 86 and a backwall 78 thereby applying a spring bias which urges the second finger 86 in the general direction of arrow 136 as shown in FIG. 7. As the first finger 84 is further urged in the general direction of arrow 137, the spring bias of the spring 79 applies a force to the second finger 86 which causes the bullet 42 to be grasped between the first finger 84 and the second finger 86. At the end of travel of the advancement mechanism 80, the bullet 42 is (1) vertically aligned with the bullet opening 74, (2) grasped by the first finger 84 and the second finger 86, and (3) suspended over the bullet opening 74. This places the advancement plate 82 in a second plate position and the bullet 42 in a second bullet position. It should be appreciated that the bullet 42 is positioned between the plunger 92 and the casing 40 when the bullet 42 is positioned in the second bullet position as shown in FIG. 7. It should further be appreciated that at this point in the cycle of the handle 26, the release mechanism 120 allows the plunger 92 to be driven downwardly by the compressed spring 94 in the general direction of arrow 34 thereby contacting the bullet 42 and forcing the bullet 42 into the mouth 43 of the casing 40 as shown in FIG. 5. It should still further be appreciated that the lower end of the plunger 92 can have a nylon member secured thereto to prevent the plunger 92 from damaging the bullet 42 as the plunger 92 is driven downwardly into contact with the bullet 42.

Thereafter, cycling the handle 26 advances the cartridge 38 to a crimping station 126, where the cartridge is pressed in a set of crimping dies 128. The crimping dies perform two functions, (1) they press the bullet 42 into the casing 40 to a proper depth and (2) they reduce the diameter of the mouth 43, to the diameter required for firing the cartridge 38. One set of crimping dies which may be used in the present invention is available from Hornady Manufacturing of Grand Island, Nebr., and is included in the .38/.357/.357 Max 3 die set.

Figure 8:
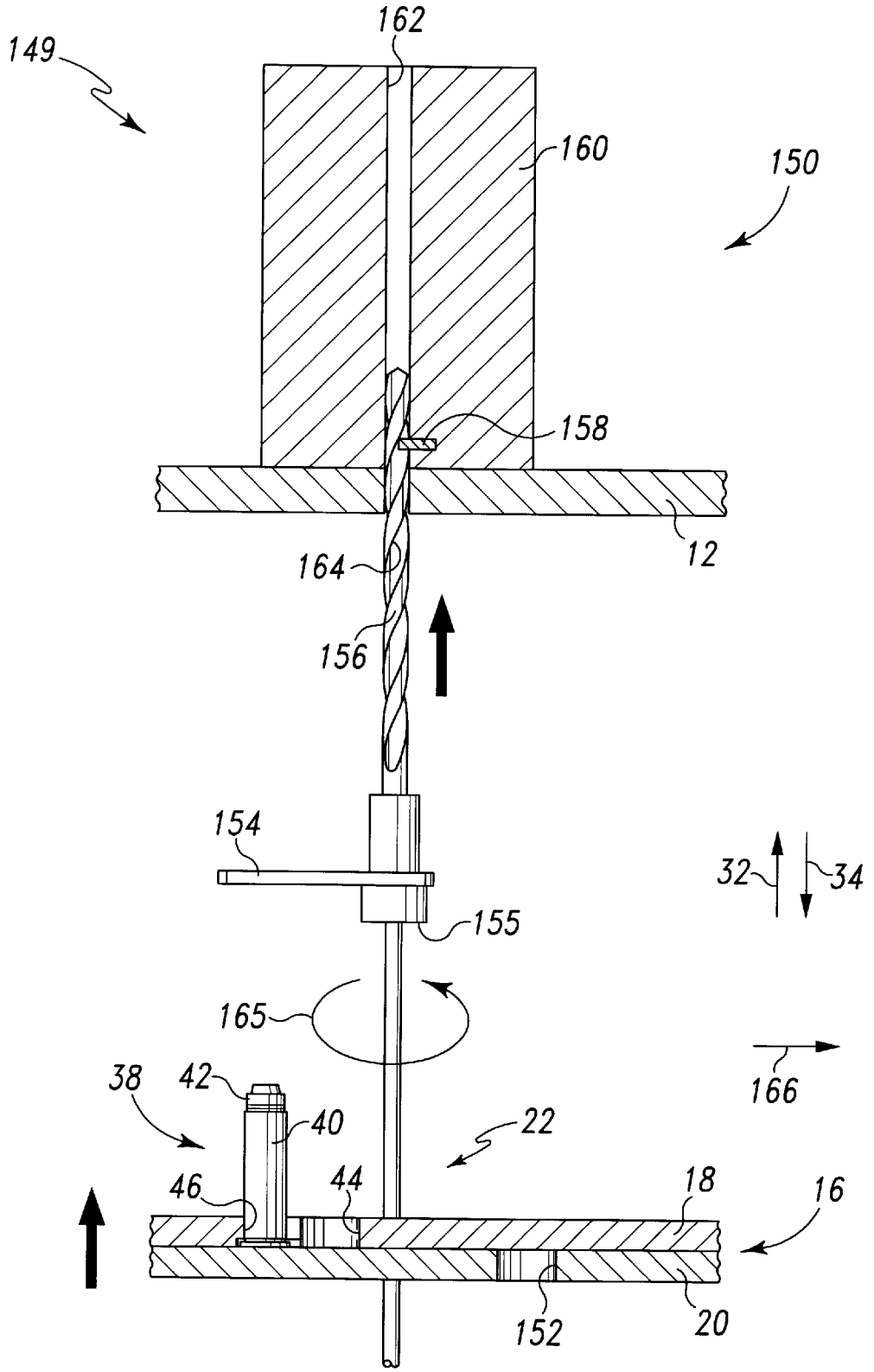
FIG. 8 is an enlarged cross sectional view of the ejection assembly of the reloader of FIG. 1, with the sweep arm shown positioned at its first sweep position (note the bullet and rod are not shown in cross section for clarity of description)
Figure 9:
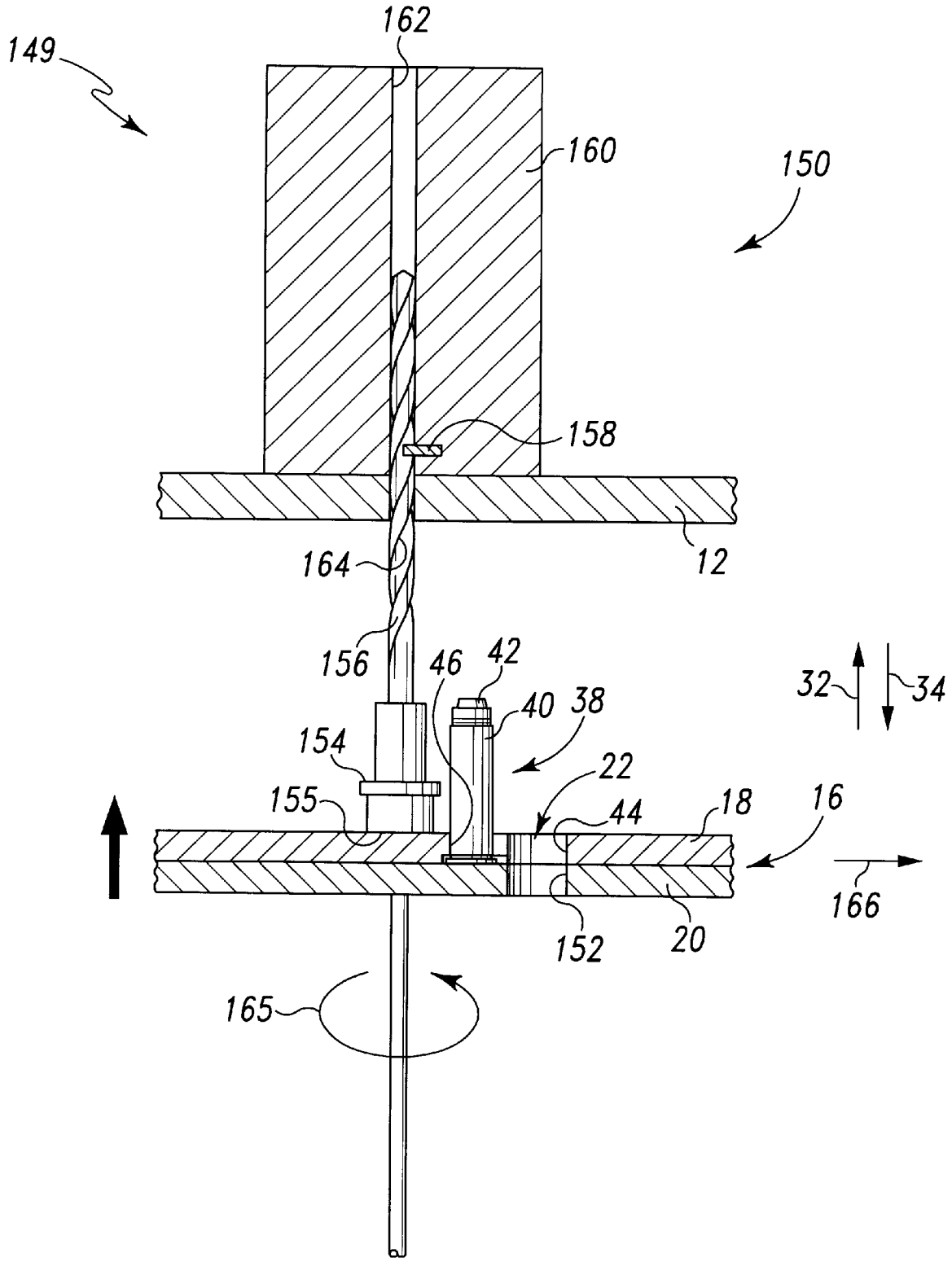
FIG. 9 is view similar to FIG. 8, but showing the sweep arm positioned at an intermediate position which is between its first sweep position and its second sweep position.
Figure 10:
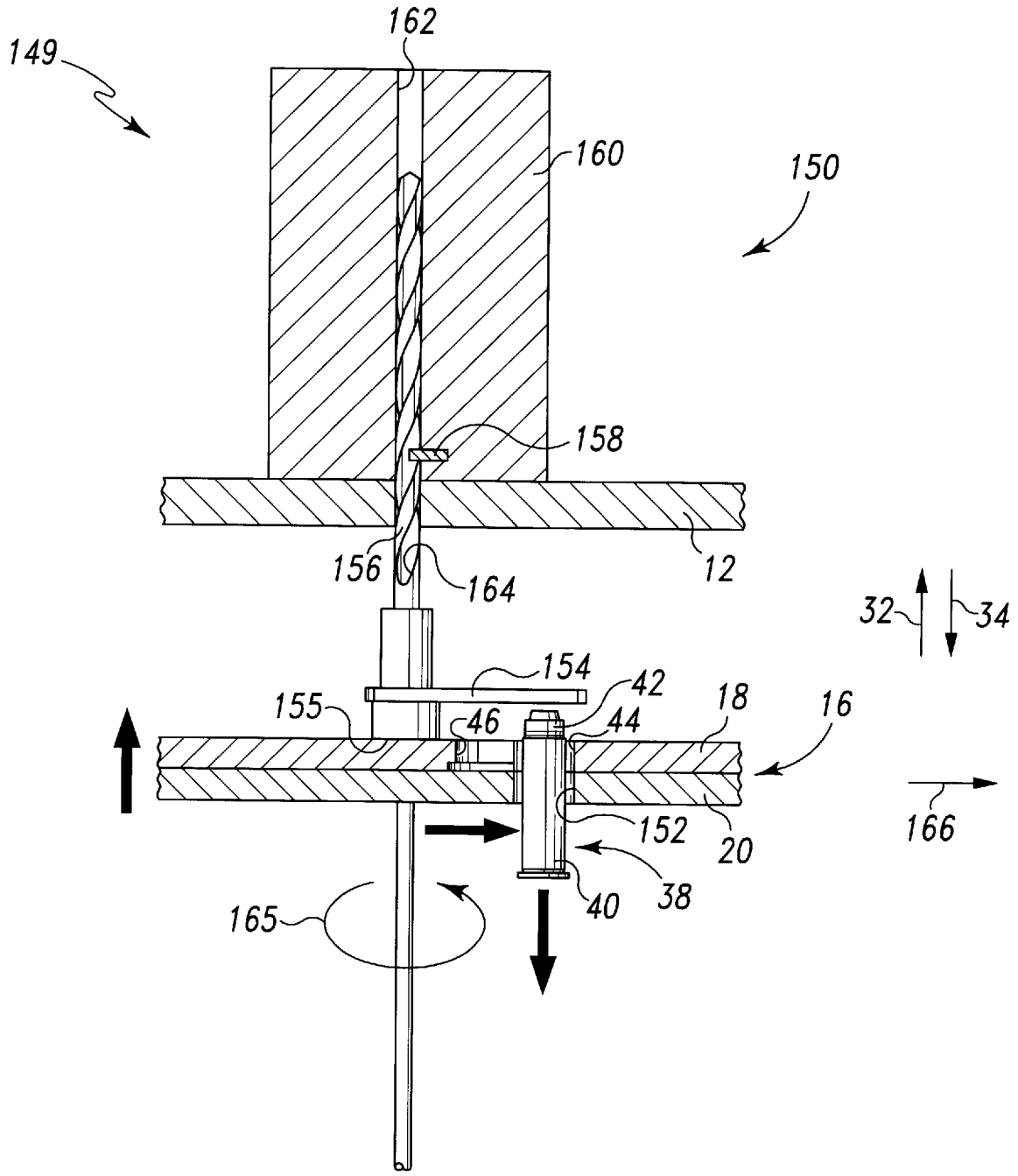
FIG. 10 is view similar to FIG. 8, but showing the sweep arm positioned in its second sweep position.

Referring now to FIGS. 8–10, further cycling the handle advances the finished cartridge 38 to the ejection station 149, where an ejection assembly 150 removes the cartridge 38 from support assembly 16. In particular, an ejection aperture 152 is defined in the lower support 20. The ejection aperture 152 is positioned over an ejection ramp 170 as shown in FIGS. 1–2. The ejection assembly 150 includes a swing arm 154, a rod 156, a guide pin 158, and an ejection support 160. The ejection support 160 is secured to the upper platform 12 and has an aperture 162 extending therethrough which receives the rod 156. In particular, the rod 156 has helical grooves 164 cut on the outer surface thereby allowing the guide pin 158 to be positioned in the helical grooves 164. The other end of the rod 156 is attached to the swing arm 154. It should be appreciated that as the rod 156 moves in the general direction of arrow 32, the guide pin 158 cooperates with the helical grooves 164 such that the rod 156 and the swing arm 154 rotate in the general direction of arrow 165.

At the end of an upward stroke of the handle 26, the upper support 18 is advanced in the general direction of arrow 166 thereby positioning the feed section 44 of the casing aperture 22 directly above the ejection aperture 152 as shown in FIGS. 9–10. On the subsequent downward stroke of the handle 26, the support assembly 16 is moved in the direction of arrow 32 as shown in FIG. 9. As the upper support 18 contacts the lower surface 155 of the swing arm 154, the upper support 18 urges the rod 156 in the general direction of arrow 32 thereby rotating the rod 156 and the swing arm 154 in the direction of arrow 165. As the swing arm 154 rotates, the swing arm 154 contacts the cartridge 38 and urges the cartridge 38 in the general direction of arrow 166 thereby advancing the cartridge 38 from the holding section 46 to the feed section 44 of the casing aperture 22. When the cartridge is positioned in the feed section 44, gravity advances the cartridge 38 in the general direction of arrow 34, through the ejection aperture 152 as shown in FIG. 10. The cartridge then advances to the ejection ramp 170 shown in FIGS. 1–2 and thereafter into a receptacle (not shown).

Industrial Applicability

In operation, each cycle of the handle 26 initiates the operations at the respective workstation thereby allowing a number of cartridges to rapidly be reloaded.

Before beginning the reloading operation, the casing feed tube 49 is loaded with casings 40, the primer feed tube 59 is loaded with charged primers, the gunpowder dispenser 64 is filled with gunpowder, and the bullet feed tube 72 is loaded with bullets 42.

The first cycle of the handle 26, loads a first casing on the support assembly 16 at the casing feed station 47. A second cycle of the handle advances the casing to the primer removal station 53, where the spent primer is removed and the casing is resized. Also, a second casing is loaded on the support assembly 16 at the casing feed station 47.

A third cycle of the handle 26 advances the first casing to the primer insertion station 57 where a charged primer is inserted into the first casing, and advances the first casing to an expanding station 61 where the mouth of the casing is enlarged. Also, the second casing is advanced to the primer removal station 53, and a third casing is loaded on the support assembly 16 at the casing feed station 47.

A fourth cycle of the handle 26 advances the first casing to the dispensing station 64 where a predetermined amount of gunpowder is placed in the mouth 43 of the first casing. Also, the second casing is advanced through the primer insertion station 57 and the expanding station 61, the third casing is advanced to the primer removal station 53, and a fourth casing is loaded on the support assembly 16 at the casing feed station 47.

A fifth cycle of the handle 26 advances the first casing to the nonfunctional station where no reloading operation is performed. The second casing is advanced to the dispensing station 64, the third casing is advanced through the primer insertion station 57 and the expanding station 61, the fourth casing is advanced to the primer removal station 53, and a fifth casing is loaded on the support assembly 16 at the casing feed station 47.

A sixth cycle of the handle 26 advances the first casing to bullet setting station 68 where a bullet 42 is positioned above the mouth of the first casing and the plunger 92 drives the bullet 42 into the mouth 43 of the first casing. The second casing is advanced to the nonfunctional station, the third casing is advanced to the dispensing station 64, the fourth casing is advanced through the primer insertion station 57 and the expanding station 61, the fifth casing is advanced to the primer removal station 53, and a sixth casing is loaded on the support assembly 16 at the casing feed station 47.

A seventh cycle of the handle 26 advances the first casing to the crimping station 126 where the crimping dies 128 press the bullet 42 into the first casing and return the mouth 43 of the first casing to its original diameter. The second casing is advanced to bullet setting station 68, the third casing is advanced to the nonfunctional station, the fourth casing is advanced to the dispensing station 64, the fifth casing is advanced through the primer insertion station 57 and the expanding station 61, the sixth casing is advanced to the primer removal station 53, and a seventh casing is loaded on the support assembly 16 at the casing feed station 47.

An eighth cycle of the handle 26 advances the first casing to the ejection station 149 where the completed cartridge 38 is ejected from the reloader 10. The second casing is advanced to the crimping station 126, the third casing is advanced to bullet setting station 68, the fourth casing is advanced to the nonfunctional station, the fifth casing is advanced to the dispensing station 64, the sixth casing is advanced through the primer insertion station 57 and the expanding station 61, the seventh casing is advanced to the primer removal station 53, and an eighth casing is loaded on the support assembly 16 at the casing feed station 47.

Each subsequent cycle of the handle 26, loads a casing 40 onto the support assembly 16 at the casing feed station 47, and ejects a finished cartridge 38 from the reloader 10 at the ejection station 149.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

It should further be appreciated that the reloader 10 can be used to reload cartridges 38 of a first caliber (i.e. size), and thereafter reload cartridges 38 of a second caliber. This can be accomplished by reloading cartridges 38 of a first caliber with a first set of components of the reloader 10 which are configured for the first caliber cartridge as described above with regard to FIGS. 1–10, and thereafter substituting the first set of components for a second set of components which are configured for a second caliber. In particular, the first set of components are adapted to reload a .38 caliber cartridge 38, while the second set of components are adapted to reload a .44 caliber cartridge 38. The various components of the first and second set of components include (1) the casing feed tube 49, (2) the upper support 18, (3) the deprimer 54, (4) the expanding dies 54, (5) the bullet feed tube 72, (6) the advancement plate 82, and (7) the crimping dies 128.

What is claimed is:

1. A reloading apparatus, comprising:

a support for supporting a casing;

a casing feed station for placing said casing on said support;

a primer removal station for removing a spent primer from said casing and resizing said casing;

a primer insertion station for inserting a charged primer into said casing;

an expanding station for enlarging a diameter of a mouth of said casing;

a gunpowder dispensing station for dispensing a quantity of gunpowder into said casing;

a bullet setting station for setting a bullet into said casing so as to form a cartridge, said bullet setting station includes (1) a bullet aligner for positioning a bullet adjacent said mouth of said casing, and (2) a plunger which is movable between a first plunger position and a second plunger position, wherein said plunger contacts said bullet so as to advance said bullet into said mouth of said casing when said plunger is moved from said first plunger position to said second plunger position;

a crimping station for advancing said bullet a distance into said casing and reducing said diameter of said mouth of said casing; and an ejection station for ejecting said cartridge from said support, wherein said support includes (1) an upper support and (2) a lower support, wherein said upper support has a plurality of casing apertures defined therein, wherein each of said casing apertures includes (1) a feed section, and (2) a holding section, wherein said feed section has a first width, wherein said holding section has a second width, and wherein said first width is greater than said second width.

2. The apparatus of claim 1, wherein said casing has a rim extending therefrom an end thereof, said upper support has a rim recess defined therein, and said rim is located in said rim recess when said casing is located in said holding section.

3. The apparatus of claim 2, wherein:

said end of said casing has a third width, said third width is less than said first width, and said third width is greater than said second width.

4. The apparatus of claim 3, wherein:

said upper support is movable relative to said lower support from a first support position to a second support position, and said rim recess is advanced toward said rim of said casing during movement of said upper support from said first support position to said second support position.

5. The apparatus of claim 4, wherein:

said ejection station includes a sweep arm which is movable from a first sweep position to a second sweep position, said lower support has an ejection aperture defined therein, and when said feed section of said casing aperture is located over said ejection aperture, said sweep arm moves from said first sweep position to said second sweep position so as to cause said casing to advance from said holding section to said feed section whereby said casing falls through said ejection aperture.

6. A reloading apparatus, comprising:

a support for supporting a casing;

a casing feed station for placing said casing on said support;

a primer removal station for removing a spent primer from said casing and resizing said casing;

a primer insertion station for inserting a charged primer into said casing;

an expanding station for enlarging a diameter of a mouth of said casing;

a gunpowder dispensing station for dispensing a quantity of gunpowder into said casing;

a bullet setting station for setting a bullet into said casing so as to form a cartridge, said bullet setting station includes (1) a bullet aligner for positioning a bullet adjacent said mouth of said casing, and (2) a plunger which is movable between a first plunger position and a second plunger position, wherein said plunger contacts said bullet so as to advance said bullet into said mouth of said casing when said plunger is moved from said first plunger position to said second plunger position;

a crimping station for advancing said bullet a distance into said casing and reducing said diameter of said mouth of said casing; and an ejection station for ejecting said cartridge from said support, wherein said bullet setting station further includes (1) a spring which is movable between a relaxed state and a compressed state, and (2) a release mechanism which allows said spring to move from said compressed state to said relaxed state, and wherein said plunger is moved from said first plunger position to said second plunger position when said spring is moved from said compressed state to said relaxed state.

7. The apparatus of claim 6, further comprising a chain which is secured to said plunger, wherein:

said spring has a central passage extending therethrough, said chain extends through said central passage of said spring, said chain has a locking notch defined therein, said chain is movable between a first chain position and a second chain position, said release mechanism includes a locking member which engages said locking notch to hold said chain in said second chain position, said spring is positioned in said compressed state when said chain is positioned in said second chain position, said spring is positioned in said relaxed state when said chain is positioned in said first chain position, and disengaging said locking member from said locking notch causes said chain to move from said second chain position to said first chain position.

8. A reloading apparatus, comprising:

a support for supporting a casing;

a casing feed station for placing said casing on said support;

a primer removal station for removing a spent primer from said casing and resizing said casing;

a primer insertion station for inserting a charged primer into said casing;

an expanding station for enlarging a diameter of a mouth of said casing;

a gunpowder dispensing station for dispensing a quantity of gunpowder into said casing;

a bullet setting station for setting a bullet into said casing so as to form a cartridge, said bullet setting station includes (1) a bullet aligner for positioning a bullet adjacent said mouth of said casing, and (2) a plunger which is movable between a first plunger position and a second plunger position, wherein said plunger contacts said bullet so as to advance said bullet into said mouth of said casing when said plunger is moved from said first plunger position to said second plunger position;

a crimping station for advancing said bullet a distance into said casing and reducing said diameter of said mouth of said casing; and an ejection station for ejecting said cartridge from said support, wherein said bullet aligner comprises (i) a bullet support which has a first bullet opening defined therein, (ii) an advancement plate positioned over said bullet support, said advancement plate having a second bullet opening defined therein, (iii) a first finger secured to said advancement plate, and (iv) a second finger which is spaced apart and spring biased toward said first finger.

9. The apparatus of claim 8, wherein:

said advancement plate moves relative to said bullet support from a first plate position to a second plate position, said first bullet opening is misaligned with said second bullet opening when said advancement plate is positioned in said first plate position, and said first bullet opening is aligned with said second bullet opening when said advancement plate is positioned in said second plate position.

10. The apparatus of claim 9, further comprising a feed tube, wherein:

said feed tube is positioned over said second bullet opening of said advancement plate when said advancement plate is located in said first plate position, said bullet is advanced through said feed tube so as to be positioned in said second bullet opening of said advancement plate when said advancement plate is located in said first plate position, said bullet is advanced by said advancement plate so as to be positioned over said first bullet opening of said bullet support when said advancement plate is located in said second plate position, and said bullet is grasped by said first finger and said second finger when said advancement plate is located in said second plate position whereby said bullet is suspended over said first bullet opening.

11. The apparatus of claim 10, wherein:

said upper support is movable between a first support position and a second support position, said mouth of said casing is aligned with said first bullet opening when said upper support is positioned in said second support position, said plunger is aligned with said bullet when said plunger is positioned in said second plunger position, and said bullet is advanced through said first bullet opening and into said mouth of said casing when said plunger is moved from said first plunger position to said second plunger position.

12. A method of reloading a casing, comprising the steps of:

placing a casing on a support;

removing a spent primer from the casing and resizing the casing;

inserting a charged primer into the casing;

enlarging a diameter of a mouth of the casing;

dispensing a quantity of gunpowder into the casing;

setting a bullet into the casing so as to form a cartridge, wherein the setting step includes the steps of (1) aligning the bullet adjacent the mouth of the casing, and (2) contacting the bullet with a plunger so as to advance the bullet into the mouth of the casing;

advancing the bullet a distance into the casing and reducing the diameter of the mouth of the casing; and ejecting the cartridge from the support, wherein the contacting step includes the steps of (i) moving a spring from a compressed state to a relaxed state, and (ii) moving the plunger so as to contact the bullet in response to the spring moving step.

13. An apparatus for setting a bullet into a casing, comprising:

a support for supporting said casing;

a bullet aligner for positioning said bullet adjacent a mouth of said casing;

a plunger which is movable between a first plunger position and a second plunger position, wherein said plunger contacts said bullet so as to advance said bullet into said mouth of said casing when said plunger is moved from said first plunger position to said second plunger position; and a spring which is movable between a relaxed state and a compressed state; and a release mechanism which allows said spring to move from said compressed state to said relaxed state, wherein said plunger is moved from said first plunger position to said second plunger position when said spring is moved from said compressed state to said relaxed state.

14. The apparatus of claim 13, further comprising a chain which is secured to said plunger, wherein:

said spring has a central passage extending therethrough, said chain extends through said central passage of said spring, said chain has a locking notch defined therein, said chain is movable between a first chain position and a second chain position, said release mechanism includes a locking member which engages said locking notch to hold said chain in said second chain position, said spring is positioned in said compressed state when said chain is positioned in said second chain position, said spring is positioned in said relaxed state when said chain is positioned in said first chain position, and disengaging said locking member from said locking notch causes said chain to move from said second chain position to said first chain position.

15. An apparatus for setting a bullet into a casing, comprising:

a support for supporting said casing;

a bullet aligner for positioning said bullet adjacent a mouth of said casing; and a plunger which is movable between a first plunger position and a second plunger position, wherein said plunger contacts said bullet so as to advance said bullet into said mouth of said casing when said plunger is moved from said first plunger position to said second plunger position, ,wherein said bullet aligner comprises (i) a bullet support which has a first bullet opening defined therein, (ii) an advancement plate positioned over said bullet support, said advancement place having a second bullet opening defined therein, (iii) a first finger secured to said advancement plate, and (iv) a second finger which is spaced apart and spring biased toward said first finger.

16. The apparatus of claim 15, wherein:

said advancement plate moves relative to said bullet support from a first plate position to a second plate position, said first bullet opening is spaced apart from said second bullet opening when said advancement plate is positioned in said first plate position, and said first bullet opening is aligned with said second bullet opening when said advancement plate is positioned in said second plate position.

17. The apparatus of claim 16, further comprising a feed tube, wherein:

said feed tube is positioned over said second bullet opening of said advancement plate when said advancement plate is located in said first plate position.

18. The apparatus of claim 17, wherein:

said bullet is advanced through said feed tube so as to be positioned in said second bullet opening of said advancement plate when said advancement plate is located in said first plate position, said bullet is advanced by said advancement plate so as to be positioned over said first bullet opening of said bullet support when said advancement plate is located in said second plate position, and said bullet is grasped by said first finger and said second finger when said advancement plate is located in said second plate position whereby said bullet is suspended over said first bullet opening.

19. The apparatus of claim 18, wherein:

said support is movable between a first support position and a second support position, said mouth of said casing is aligned with said first bullet opening when said support is positioned in said second support position, said plunger is aligned with said bullet when said plunger is positioned in said second plunger position, and said bullet is advanced through said first bullet opening and into said mouth of said casing when said plunger is moved from said first plunger position to said second plunger position.

* * * * *